US010018448B2

(12) United States Patent
Klymenko et al.

(10) Patent No.: US 10,018,448 B2
(45) Date of Patent: Jul. 10, 2018

(54) BAG FOR UNDERCOVER CARRYING OF GUN WITH FAST OPENING SYSTEM

(71) Applicants: Mykola Klymenko, Dniper (UA); Sergii Kyrpa, Dniper (UA)

(72) Inventors: Mykola Klymenko, Dniper (UA); Sergii Kyrpa, Dniper (UA)

( * ) Notice: Subject to any disclaimer, the term of this patent is extended or adjusted under 35 U.S.C. 154(b) by 51 days.

(21) Appl. No.: 15/258,553

(22) Filed: Sep. 7, 2016

(65) Prior Publication Data

US 2018/0066917 A1 Mar. 8, 2018

(51) Int. Cl.
*F41C 33/04* (2006.01)
*F41C 33/02* (2006.01)

(52) U.S. Cl.
CPC ..... *F41C 33/048* (2013.01); *F41C 33/0209* (2013.01)

(58) Field of Classification Search
CPC ..... A45F 5/022; A45C 1/04; F41C 33/048
USPC ..... 224/587, 911
See application file for complete search history.

(56) References Cited

U.S. PATENT DOCUMENTS 3,347,299 A * 10/1967 Velda ..... A45C 3/06 150/106
3,965,706 A * 6/1976 Davis ..... A44B 19/301 190/120
4,966,320 A * 10/1990 DeSantis ..... A45C 1/04 224/192
5,150,824 A * 9/1992 Alvarez ..... A45C 7/0068 224/586
5,170,919 A * 12/1992 DeSantis ..... A45C 1/04 224/192
5,209,383 A * 5/1993 Theodore ..... F41C 33/0227 224/193
5,294,031 A * 3/1994 Volpei ..... A45F 3/00 224/192
D347,940 S * 6/1994 Linscott ..... D3/226
5,374,919 A * 12/1994 Zelka ..... G08B 15/004 224/196
5,495,967 A * 3/1996 Parton ..... A45C 3/06 190/106
5,505,355 A * 4/1996 Williams ..... A45C 1/04 224/243
5,584,424 A * 12/1996 Stava ..... A45F 3/00 224/240
5,662,219 A * 9/1997 Tschudy ..... A45C 13/02 150/113
5,683,022 A * 11/1997 Evans ..... A41F 9/002 224/583
5,829,653 A * 11/1998 Kaiser ..... A45F 4/02 2/2.5
5,909,834 A * 6/1999 Parrott, III ..... F41C 33/0209 224/245
6,131,198 A * 10/2000 Westrick ..... F41C 33/0209 2/102
8,328,058 B2 * 12/2012 Wilson ..... A45F 3/005 224/243

(Continued)

*Primary Examiner* — Brian D Nash

(57) ABSTRACT

A bag for undercover carrying of a gun that has an internal pocket, several external pockets and fast opening system. The internal pocket is designed to contain the gun. The external pockets cover the internal pocket that has an opening part that has a substantially narrow like-tab structure. The opening part is closed by a bidirectional zipper and a quick release closing means.

1 Claim, 4 Drawing Sheets

(56) References Cited

U.S. PATENT DOCUMENTS

| | | | | |
|---|---|---|---|---|
| 8,622,269 | B2 * | 1/2014 | Hogue | F41C 33/0218 224/587 |
| 9,476,675 | B1 * | 10/2016 | Manglos | F42B 39/02 |
| 9,772,162 | B2 * | 9/2017 | Manglos | F42B 39/02 |
| 2003/0205595 | A1 * | 11/2003 | Young | A45F 5/02 224/230 |
| 2005/0223466 | A1 * | 10/2005 | Jennings | A41D 13/0012 2/102 |
| 2006/0011687 | A1 * | 1/2006 | Wadley | A45F 3/00 224/587 |
| 2007/0080182 | A1 * | 4/2007 | Thatcher | A45F 3/14 224/148.4 |
| 2008/0223892 | A1 * | 9/2008 | Hamilton | A45F 5/00 224/587 |
| 2012/0117713 | A1 * | 5/2012 | Hoffner | A41D 27/20 2/227 |
| 2012/0152995 | A1 * | 6/2012 | Wilson | A45F 3/005 224/587 |
| 2014/0312089 | A1 * | 10/2014 | Liu | F41C 33/0209 224/587 |
| 2015/0122861 | A1 * | 5/2015 | Adams | F41C 33/0218 224/587 |
| 2016/0076852 | A1 * | 3/2016 | Liu | F41C 33/0209 224/587 |

* cited by examiner

BAG FOR UNDERCOVER CARRYING OF GUN WITH FAST OPENING SYSTEM

TECHNICAL FIELD

The present invention relates to a bag for undercover carrying of a gun.

BACKGROUND ART

Official security forces need sometimes to use armed undercover security officers or policemen amongst crowd or in the public area in general. Usually, the gun or the holster that such undercover officers carry on their body can be noticed in their pocket or under their clothes, and they are in the risk to be discovered. This problem relates in fact to any person who wants to carry a gun and wishes that no one will notice that he carries a gun. The present invention aims to provide an effective and efficient solution for this problem.

LIST OF DRAWINGS

The intention of the drawings attached to the application is not to limit the scope of the invention and its application. The drawings are intended only to illustrate the invention and they constitute only one of its many possible implementations.

Figure 1:
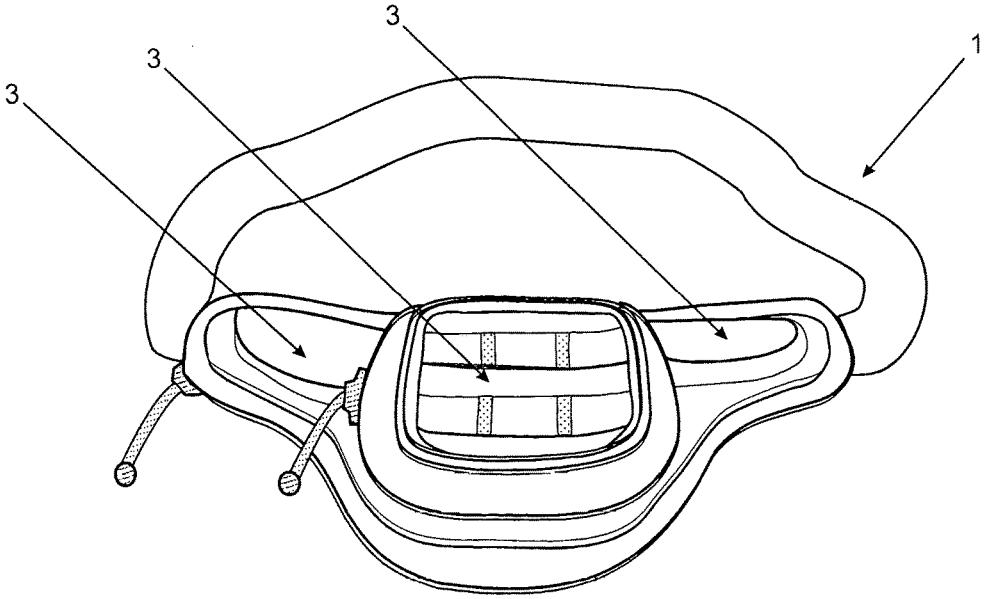

FIG. 1 describes the bag for undercover gun (1) with several external pockets (3) in a closed state.

Figure 2:
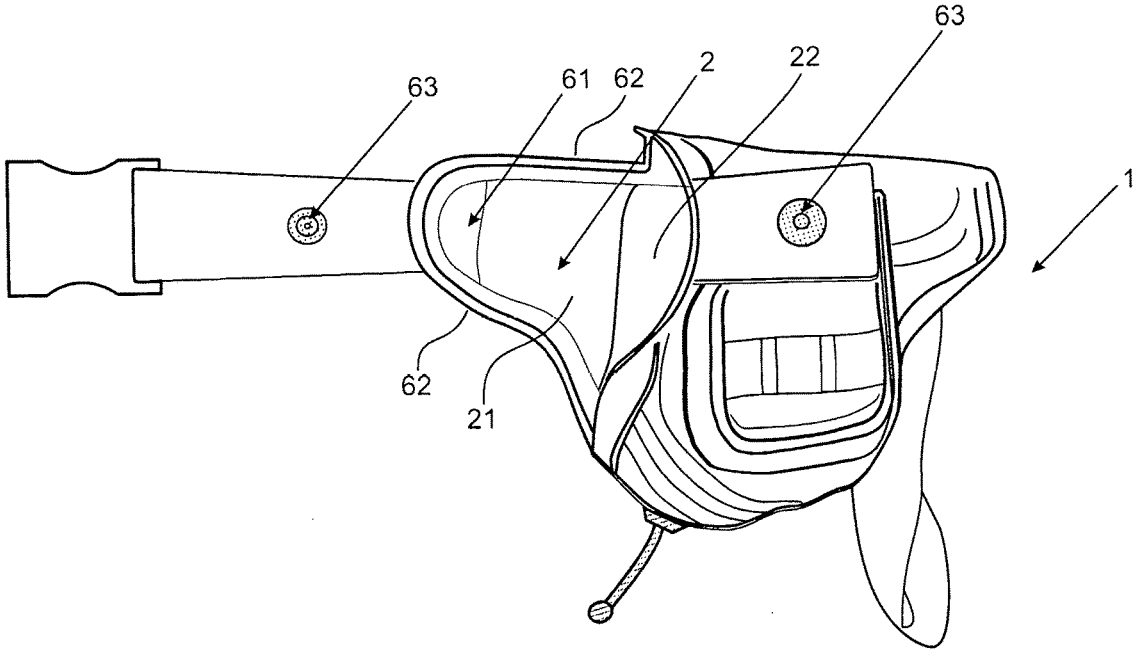
Figure 3:
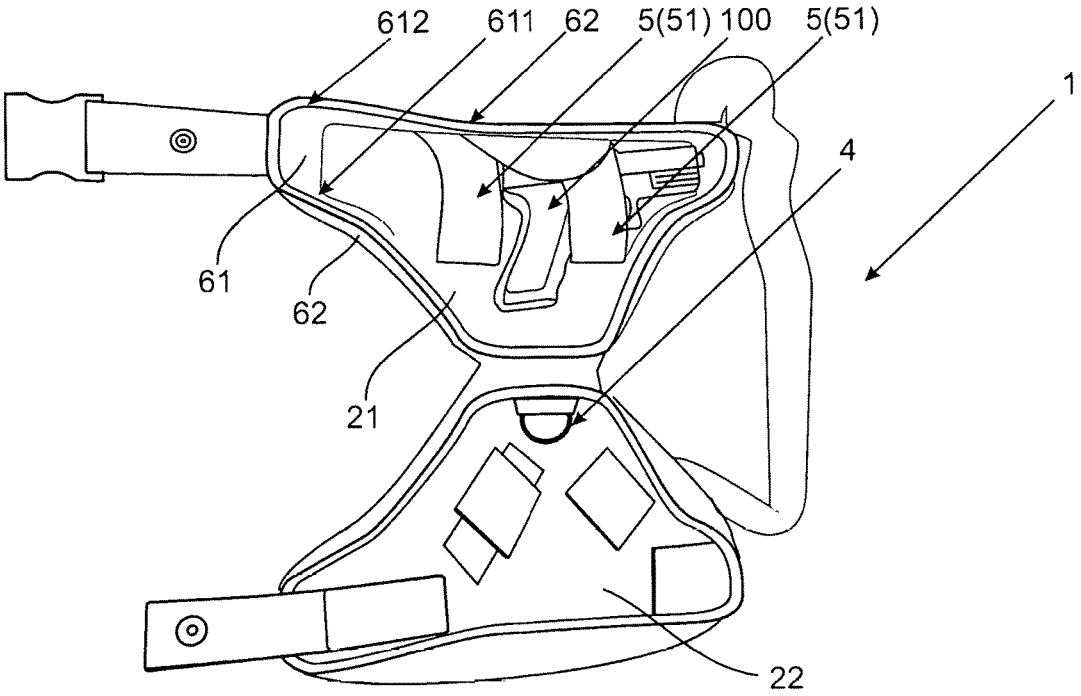

FIGS. 2 and 3 depict the bag for undercover gun (1) in an opened state.

Figure 4:
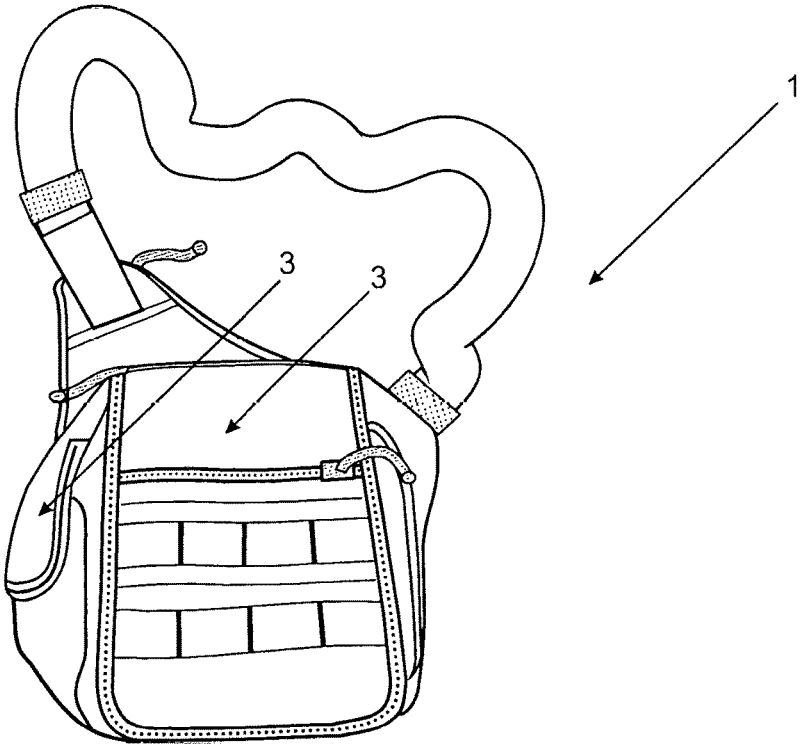

FIG. 4 describes the bag for undercover gun (1) with several external pockets (3) in a closed state.

Figure 5:
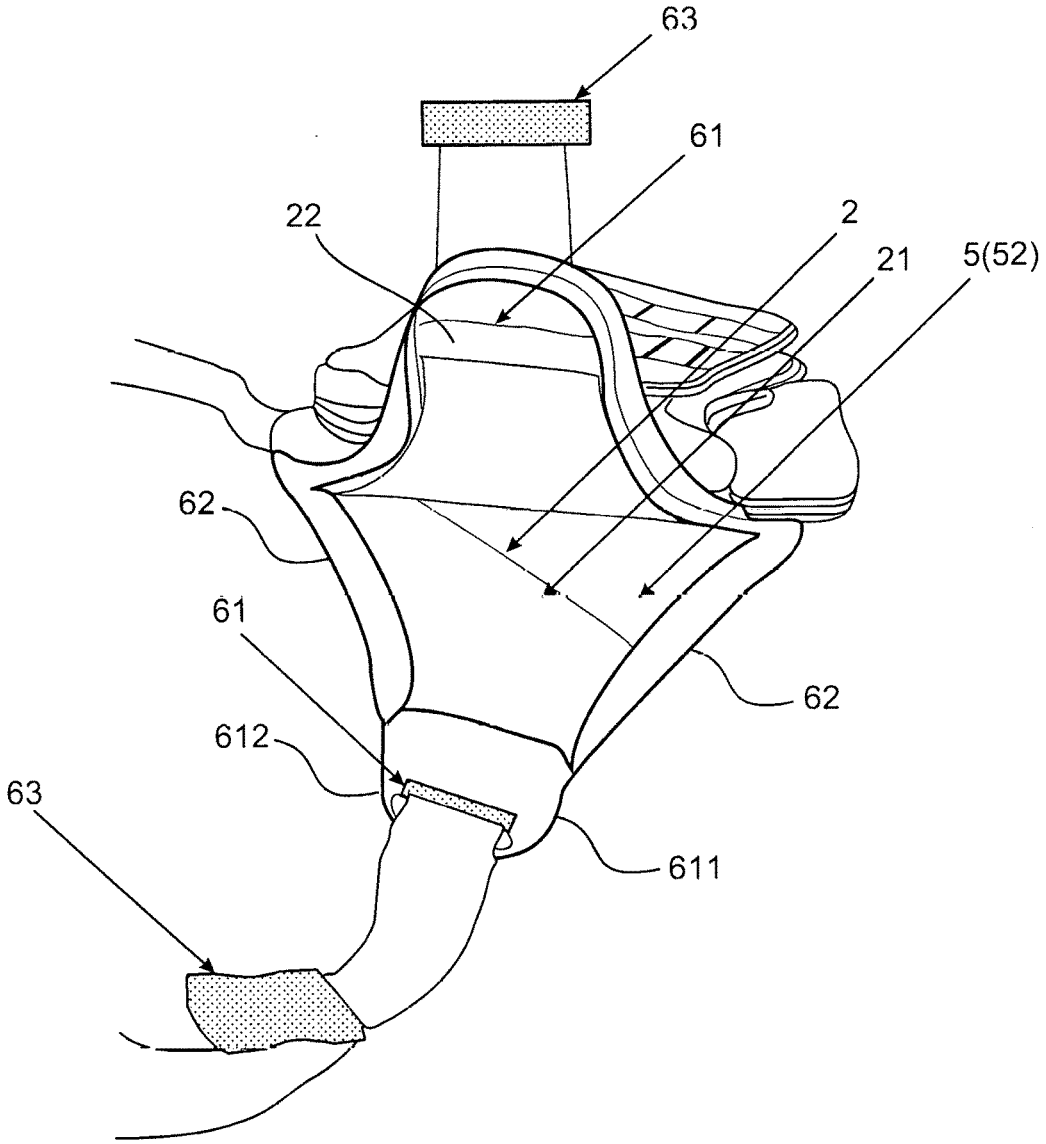

FIG. 5 depicts the bag for undercover gun (1) in an opened state.

Figure 6:
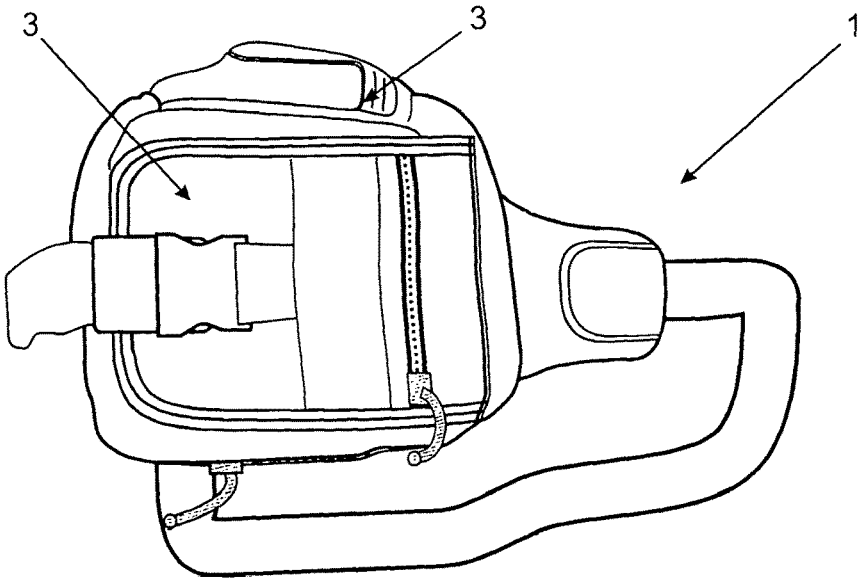

FIG. 6 describes the bag for undercover gun (1) with several external pockets (3) in a closed state.

Figure 7:
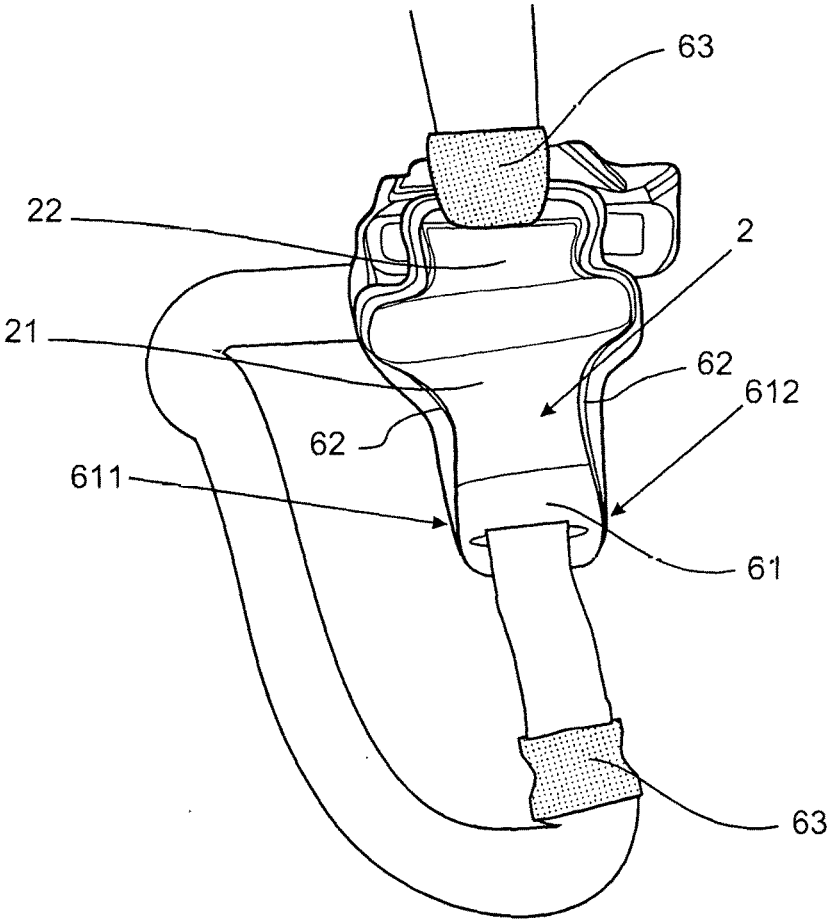

FIG. 7 depicts the bag for undercover gun (1) in an opened state.

THE INVENTION

The main object of the present invention is to provide a bag for undercover carrying of a gun (1). Another object of the present invention is to provide the bag (1) wherein it includes an internal pocket (2) in which the user supposes to hide the gun (100). Yet, another object of the present invention is to provide the bag (1) that includes a fast opening system (6) of the internal pocket (2) for cases of immediate need. Another object of the present invention is to provide the bag (1) wherein it has several external pockets (3) that blur the outline of the gun (100) which is hidden in the internal pocket (2). In addition, another object of the present invention is to provide the bag (1) wherein it looks like an ordinary bag and not like a bag for carrying a gun. Another object of the present invention is to provide the bag (1) wherein the internal pocket (2) includes an inner attachment means (5) for attaching the gun (100) to the inner side (21) of the internal pocket (2). In addition, another object of the present invention is to provide the bag (1) that includes a loop (4) inside the internal pocket (2) to enable the user to tie the gun to the loop by a string for preventing situations of losing the gun (100) during emergency activities.

The bag for undercover carrying of a gun (1) includes internal pocket (2), several external pockets (3), fast opening system (6), a loop (4), and inner attachment means (5).

External pockets (3): the bag (1) includes several external pockets (3) covering the internal pocket (2), for giving to the bag (1) an innocent ordinary look, and for blurring the outline of the gun (100) when the user hide it in the internal pocket (2). FIG. 1 shows the bag for undercover gun (1) with several external pockets (3) in a closed and innocent state.

Internal pocket (2): the bag (1) includes an internal pocket (2) that is designed to contain a gun (100). The bag (1) may also include a loop (4) inside the internal pocket (2) to enable the user to tie the gun to that loop by a string. In addition, the internal pocket (2) may include an inner attachment means (5) for attaching the gun (100) to the inner side (21) of the internal pocket (2). This inner attachment means can be closed elastic strips (51), Velcro (52) and any other known attachment means. FIG. 3 depicts the bag for undercover gun (1) wherein its internal pocket (2) is in opened state. In FIG. 3 it is possible to see the loop (4) and the attachment means (5), in the kind of strips (51). When the attachment means (5) is in the kind of elastic strips (51) it is possible to insert the gun under the closed elastic strips.

The fast opening system (6): the fast opening system (6) enables the user to open the internal pocket (2) quickly and easily in cases of immediate needs. In addition, the fast opening system (6) keeps the internal pocket (2) in a closed state effectively and safely and by that prevents the loss of the gun. The fast opening system (6) is one of the main innovative aspects of the bag (1).

The fast opening system (6) includes several basic elements: the opening part (61) of the internal pocket (2) has a substantially narrow like-tab structure; a bidirectional zipper (62) that closes the circumferential edges of the internal pocket (2), or part of it. The fact that the zipper (62) is bidirectional enables the user to open the internal pocket simultaneously along both sides (611) (612) of the opening part (61); and a quick release closing means (63) that secure the opening part (61) of the internal pocket (2) and enables the user to release it quickly. The quick release closing means (63) can be for example a snap button as described in FIGS. 2 and 3 or a quick release plastic buckle, as described in FIGS. 5 and 7.

FIGS. 2 and 3 depict the bag (1) wherein its internal pocket (2) is opened and it is possible to see its narrow like-tab opening part (61) with its both sides (611) (612) and the quick release closing means (63) in a kind of a snap button.

FIG. 4 describes another design of the bag (1) with several external pockets (3) in a closed and innocent state. FIG. 5 describes the bag (1) of FIG. 4 wherein its internal pocket (2) is opened and it is possible to see its narrow like-tab opening part (61) with its both sides (611) (612) and the quick release closing means (63) in a kind of a quick release plastic buckle.

In FIG. 5 it is possible to see the loop (4) and the attachment means (5), in the kind of Velcro (52). When the attachment means is in the kind of Velcro (52) it is possible to insert the gun whilst it is inserted inside its corresponding holster inside the internal pocket (2). In this situation, the holster has also Velcro and if can be fixed inside to internal pocket in the position that the user determine.

FIG. 6 describes another design of the bag (1) with several external pockets (3) in a closed and innocent state. FIG. 7 describes the bag (1) of FIG. 6 wherein its internal pocket (2) is opened and it is possible to see its narrow like-tab opening part (61) with its both sides (611) (612) and the quick release closing means (63) in a kind of a quick release plastic buckle.

The Internal pocket (2) includes the inner side (21) as explained above, and an outer side (22), which is clearly seen in Figures number 2, 3, 5 and 7. As it shown and understood from the Figures, the inner side (21) of the internal pocket (2) is in fact the side that faces the body of the user when he or she hangs the bag (1) on their body while the outer side (22) is facing outward. As it shown and understood from the Figures, especially FIGS. 2, 5 and 7, the external pockets (3) cover the outer side (22) of the internal pocket (2) and not the sided sides of it. As it shown and understood from the figures and the explanations above, the bidirectional zipper (62) closes part of the circumferential edges of the internal pocket (2) and is designed to enable the user to open the internal pocket simultaneously along both opposite sides (611) (612) of the opening part (61). As it shown and understood from the figures and the explanations above, the opening part (61) of the internal pocket (2) has a narrow like-tab structure and it is a part of the inner side (21) and the outer side (22) of the internal pocket (2). As explained above, one of the main objects of the fast opening system (6) of the bag (1) is to enable the user to open the internal pocket (2) quickly and easily and to pull out the gun quickly in cases of immediate need.

What is claimed is:

1. A bag for undercover carrying of a gun, comprising: an internal pocket, several external pockets and a fast opening system;

wherein the internal pocket has an inner side that faces a body of a user when said bag for undercover carrying of a gun is hanged on the body of the user while the outer side is facing outward; wherein the internal pocket is designed to contain the gun; wherein the several external pockets cover the outer side of the internal pocket;

wherein said internal pocket has an opening part that is a part of the inner side and the outer side of the internal pocket; wherein said internal pocket has a substantially narrow like-tab structure; wherein said opening part has two opposite sides; wherein said opening part along said two opposite sides and at least part of the internal pocket are closed by a bidirectional zipper; wherein said bidirectional zipper is designed to enable the user to open the internal pocket simultaneously along both opposite sides of the opening part; wherein said fast opening system is consisting of said opening part, said bidirectional zipper and a quick release closing means that secure the opening part;

whereby said several external pockets blurring an outline of the gun while is hidden in the internal pocket; and whereby said fast opening system enabling the user to open the internal pocket quickly and easily and to pull out the gun quickly in cases of immediate need.

* * * * *